United States Patent [19]

Wilson et al.

[11] 4,449,263

[45] May 22, 1984

[54] POWERED FOLDING SUPPORT STRUCTURE

[75] Inventors: Kermit H. Wilson, Edina; Richard C. Bue, Chaska, both of Minn.

[73] Assignee: Sico Incorporated, Minneapolis, Minn.

[21] Appl. No.: 216,982

[22] Filed: Dec. 16, 1980

Related U.S. Application Data

[63] Continuation-in-part of Ser. No. 99,655, Dec. 3, 1979, abandoned, which is a continuation-in-part of Ser. No. 69,588, Aug. 24, 1979, abandoned.

[51] Int. Cl.[3] ..... A47C 17/40

[52] U.S. Cl. ..... 5/133; 5/164 R; 14/71.3; 74/519; 74/531

[58] Field of Search ..... 5/131, 133, 164, 136, 5/137; 74/519, 531; 248/280.1, 292.1, 584, 592; 49/26; 108/7; 296/56; 14/71.3

[56] References Cited

U.S. PATENT DOCUMENTS

| | | | |
|---|---|---|---|
| 1,915,507 | 6/1933 | Wright | 5/133 |
| 2,602,664 | 7/1952 | Matchett | 49/26 |
| 3,277,736 | 10/1966 | Goodman | 5/68 |
| 3,593,350 | 7/1971 | Knight et al. | 5/68 |
| 4,337,670 | 7/1982 | Carlson | 5/164 R |

*Primary Examiner*—Alexander Grosz

*Attorney, Agent, or Firm*—Merchant, Gould, Smith, Edell, Welter & Schmidt

[57] ABSTRACT

A drive coupling for a power operated folding support structure which is pivoted between a horizontal use position and a vertical storage position by an electric drive mechanism. A drive coupling operatively couples the arm of the electric drive motor to the pivoting support frame. The drive coupling includes a friction plate which is held between a pair of friction members secured by clamping members. The frictional drive coupling transmits force from the drive motor to pivot the frame, but allows slippage in the event that an obstacle or excessive force is encountered while pivoting the frame.

4 Claims, 7 Drawing Figures

POWERED FOLDING SUPPORT STRUCTURE

This is a continuation-in-part application of our U.S. Patent application Ser. No. 99,655, filed Dec. 3, 1979, now abandoned which is a continuation-in-part of our prior U.S. Patent application Ser. No. 69,588, filed Aug. 24, 1979, now abandoned.

TECHNICAL FIELD OF THE INVENTION

The present invention relates to foldable or pivotable support structures, such as folding wall-type beds, tables or other pieces of furniture. The present invention is particularly applicable to folding wall-type beds and a power drive mechanism therefor.

BACKGROUND OF THE PRIOR ART

Numerous types of folding wall beds, desks, tables and other pieces of furniture are known in the prior art and are widely used in situations in which available space is at a premium. The bed or other piece of furniture is provided with hinges so that it can be pivoted upwards from its generally horizontal use position to a generally vertical storage position adjacent a wall or in a small closet placed in a wall for that purpose.

Because the weight involved in even a medium sized wall bed can be considerable, it has long been considered desirable to provide some type of counterbalance springs to make it easier for a person to move the bed between the use and storage positions. The same situation exists with respect to all types of pivoting or foldup loads, including but not limited to, foldup desks, tables, work counters, loading ramps or doors hinged at the bottom, or any member pivoted near its bottom for movement between a generally vertical to a generally horizontal position. For purposes of illustration, the present invention as disclosed herein is applied to a folding wall-type bed, but it will be understood that the present invention is equally applicable to any of the pivoting type loads discussed above.

Numerous types of counterbalance mechanisms have been used in prior art foldup beds. One type of counterbalance mechanism is disclosed in U.S. Pat. No. 3,999,245 to Richard C. Bue et al, the disclosure of which is incorporated herein. The counterbalance mechanism of that patent is connected between a stationary base portion or stationary frame member and a movable frame portion. The counterbalance means includes a spring operatively connected to one of the frame members, and attached to the other of the frame members and a cable or other flexible force transmitting member interconnecting the spring and the other of the hinge frame members and passing over and around a cam surface to provide a variable effective radius and leverage arm for the spring according to the position of the hinge. Because of the unique cam, which is designed in consideration of the peripheral length of the cam surface as well as the cam effective radius, a smaller effective radius is provided when the load is in its horizontal position and a larger effective radius when the load is in its vertical or stored position.

While a counterbalance mechanism, such as disclosed in the above patent, greatly reduces the amount of force which is necessary to move a folding wall-type bed between its use and storage positions, the application of such a small force can still be burdensome to some persons. For example, when a folding bed is to be used by a seriously handicapped, invalid or extremely elderly person, the application of the manual force to pivot the bed may be undesirable. However, the use of a high powered motorized mechanism for pivoting a bed between its use and storage positions could be dangerous unless safety features could be built into such a system.

SUMMARY OF THE INVENTION

The present invention is directed to a power operated folding support structure wherein a support member is movable between a generally vertical position and a generally horizontal position. A counterbalance means is operatively connected to the support member for reducing the amount of force needed to move the support member between its horizontal and vertical positions. A motor means is also operatively connected to the support member and provides the force required to move the support member between the horizontal and vertical positions.

In a preferred embodiment, the support structure is in the form of a foldable bed movable between a horizontal use position and a vertical storage position. The motor means is comprised of an electric drive motor which drives a reciprocable drive arm in a generally linear direction. The drive arm is coupled to the support member by a drive coupling that normally moves the support member in response to the motor, but which permits independent movement of the support member with respect to the drive arm or vice versa under certain situations as a safety precaution.

According to the present invention there is provided an improved drive coupling between the reciprocal drive arm and the pivotable support member, whereby in normal operation the support member is pivoted between its vertical and horizontal positions in response to operation of the drive motor and its reciprocal drive arm. However, in response to a mechanical overriding force, the drive coupling permits slippage or relative or excessive movement of the support member and the drive arm. This prevents damage to the drive mechanism and permits manual operation of the pivoting load in certain circumstances.

According to the present invention, the drive coupling comprises first and second force transmitting members, one of the force transmitting members being positioned on the movable support member, and the other being secured to the drive arm. Means are provided for urging the force transmitting members together in frictional engagement so that the normal drive force from the motor is transmitted to the pivoting support member for moving it between its vertical and horizontal positions. The amount of friction is adjusted so that an excessive mechanical force, or a manual override force supplied to the support member will cause slippage between the force transmitting members, and will permit in those circumstances motion of the support member independent of the drive arm, or vice versa.

According to a preferred embodiment, the force transmitting member secured to the support member comprises a friction plate attached to the support member and projecting perpendicularly therefrom towards the drive arm. The second force transmitting member comprises a pair of friction lining members placed on either side of the friction plate, and each backed by a clamping member. A clamping bolt passes through the clamping members and the attachment plate to provide clamping friction for the force transmitting members, and also to serve as a pivot in the event of slippage thereof. A further attachment bolt connects between the other ends of the clamping members, and is adjusted to provide the desired degree of friction.

According to a preferred embodiment, stop legs are attached to the clamping members for engaging the floor when the clamping members are pivotally moved to a position away from the support member, so as to engage the floor and prevent inadvertent overcenter positioning of the clamping members with respect to the reciprocal drive arm.

DETAILED DESCRIPTION OF THE INVENTION

Figure 1:
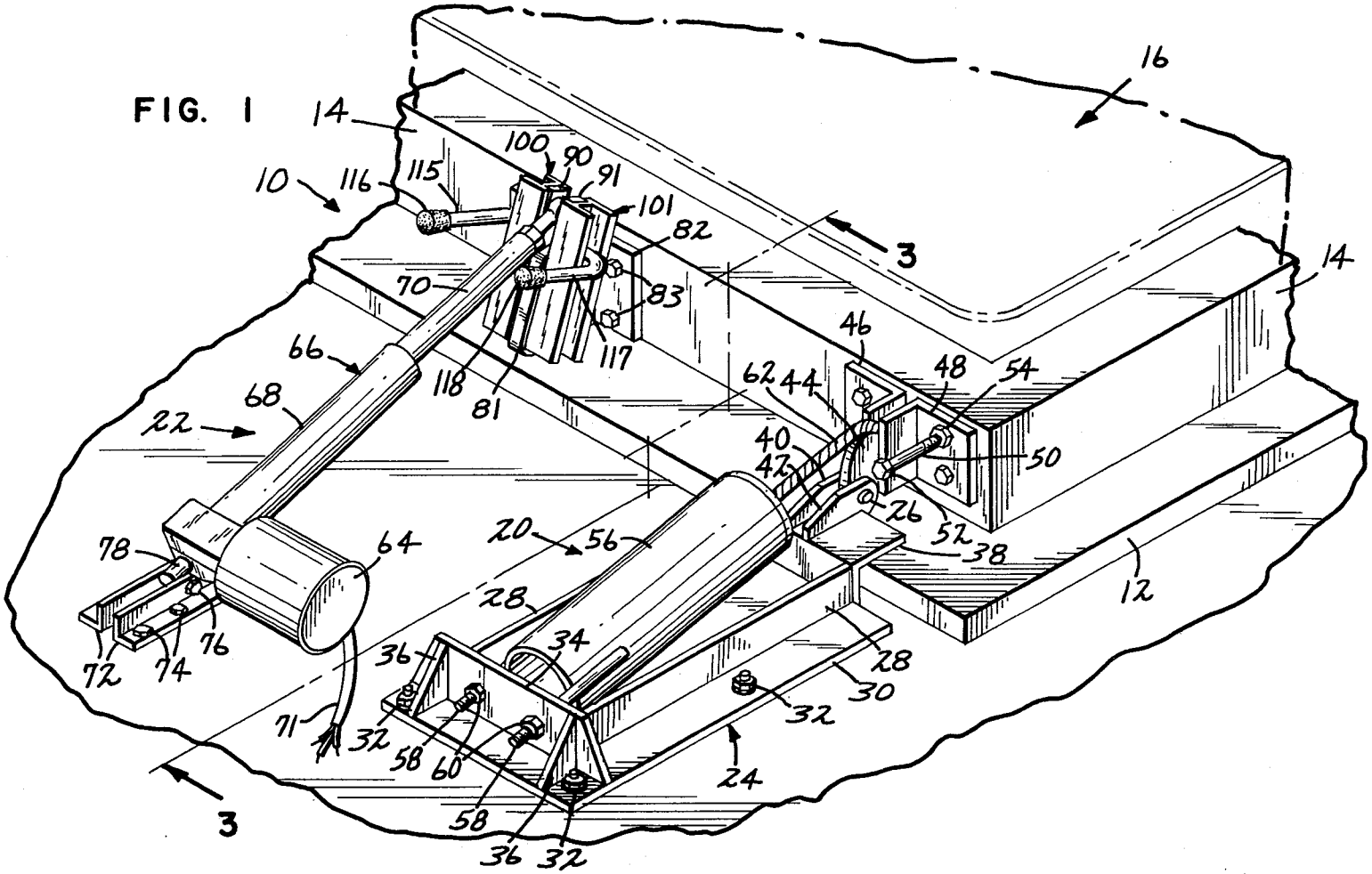
FIG. 1 is a perspective view of a portion of the folding support structure illustrating in detail a counterbalance mechanism and a motor mechanism for pivoting a movable portion of the support structure, including the drive coupling of the present invention.

Referring to the drawings in detail, wherein like numerals indicate like elements, there is illustrated in FIG. 1 a foldable or pivotable support structure designated generally as 10. The support structure is illustrated in FIG. 1 as being comprised of a folding bed having a frame member 14 and a mattress or other bedding 16 supported within the frame member 14. A panel 12 may be attached to the bottom of bed frame member 14, so that when the assembly is installed in a small closet or alcove, the panel 12 will close off the alcove by providing a surface contiguous with the wall. The frame member 14 is connected for pivotal motion between a generally horizontal and a generally vertical position by means of a hinge mechanism. A counterbalance mechanism 20 is coupled to the hinge mechanism to reduce the amount of force necessary to pivot the frame member 14 between the horizontal and vertical positions. A motor mechanism 22 provides the force or power to move the frame member 14 between the vertical and horizontal positions. In the preferred embodiment, the folding bed would have a pair of counterbalance means 20, one at either side of the pivoting edge of the bed, but only a portion of the bed including one of the counterbalance means is shown in FIG. 1. The motor and drive coupling would be positioned generally in the center of that edge of the bed.

The frame member 14 and the panel 12 pivot relative to a stationary base frame member 24 about a hinge pin 26. Base frame member 24 is adapted to be rigidly secured to the floor or to any suitable reinforcing member which is installed on the floor. The base frame member 24 preferably has vertical side rail portions 28 for strength and rigidity, and flange portions 30 which are used for securing the base frame member 24 to the floor by means of nut and bolt assemblies 32. Base frame member 24 also includes a vertical end plate 34, and suitable braces 36, which interconnect flange portion 30 and vertical end plate 34. Base frame member 24 can be cast, or can be welded from individual angle iron members, as may be desired.

At the forward end of base member 24 there is provided a shelf portion 38, which in the embodiment shown is parallel to the floor, but spaced apart therefrom. A pair of guide plates 40, 42 are welded to the shelf portion 38. The guide plates 40 and 42 are mounted in a vertical orientation, and spaced apart from each other so as to accommodate a cam member 44. The hinge pin 26 passes through holes in the guide plates 40, 42 and through an opening provided in the cam member 44 so that the cam member 44 is free to pivot thereabout. Angle members 46, 48 are welded to the sides of the cam member 44. Alternatively, the cam member 44 and angle members 46, 48 could be made from a single casting if desired. The angle members 46, 48 are fixedly connected to the frame member 14 to form a movable portion of the support structure.

A stop member is provided which comprises a bolt 50 which is threaded into a tapped hole provided in the angle member 48. When the support platform 12 is moved to its vertical position the head 52 of the bolt 50 engages the shelf portion 38 of the base frame member 24. This serves to limit the vertical motion of the support platform 12. The stop is adjustable by turning the head 52 of the bolt 50 to be threaded into or out from the angle member 48. A lock nut 54 may then be used to lock the stop in the desired position.

A cylindrical shaped spring housing 56 has a pair of anchor bolts 58 welded to the outside periphery thereof for securing the spring housing 56 to the base frame member 24, and for providing adjustment therfor. The anchor bolts 58 pass through holes provided in the vertical end plate 34 and are secured by nuts and washers 60, which aid in allowing slight adjustments in the position of the spring housing 56 as the hinge is pivoted. A coil spring (not shown) is provided within the spring housing 56. A cable 62 has a first end operatively connected to a large movable washer (not shown) within the housing which together with the end of the spring housing holds the spring in compression. The cable passes outwardly from one end of the spring housing 56 and then wraps over and around cam member 44, where its other end engages and is attached to the frame member 14. The cable 62 is also held in place on the cam surface by the angle members 46, 48. The force of the spring operating through the cable 62, and the cam plate 44 provides a counterbalancing force to the support platform 12. Additional details of the counterbalancing mechanism 20 can be found in U.S. Pat. No. 3,999,245, the disclosure of which is incorporated herein.

With the amount of force required to pivot the support frame 14, attached panel 12 and bedding 16 reduced by means of the counterbalance mechanism 20, the motor mechanism 22 need provide only a small amount of force. The motor mechanism 22 includes a low power electric motor 64 which drives a conventional traveling screw type of extendable arm indicated generally as 66. The electric motor 64 and the extendable arm mechanism 66 are of conventional design and hence will not be described in detail. A Ball Screw Actuator of Motion Systems Corporation has been found suitable. The extendable arm mechanism 66 includes a cylinder 68 and a reciprocable drive arm 70. A pair of angle members 72 are attached to the floor, or to any suitable reinforcing member which may be installed on the floor by bolts 74. The electric motor 64 and the extendable arm mechanism 66 are pivotably connected to the angle members 72 by a bolt 76. A pin or extension 78 extends from the lowermost end of the extendable arm assembly 66 and has a hole extending through it. The pin 78 is received between upright flanges of the angle members 72 and the bolt 76 passes through the hole in the upright flanges and pin 78 to thereby pivotably attach the electric motor 64 and the extendable arm assembly 66 with respect to the floor.

The electric motor 64 drives the reciprocal drive arm 70 in and out of the cylinder 68. The motor 64 is connected to a power source and control switch through conductor wires 71. The control switch is preferably the type which must be continually depressed to supply current to the motor.

Figure 2:
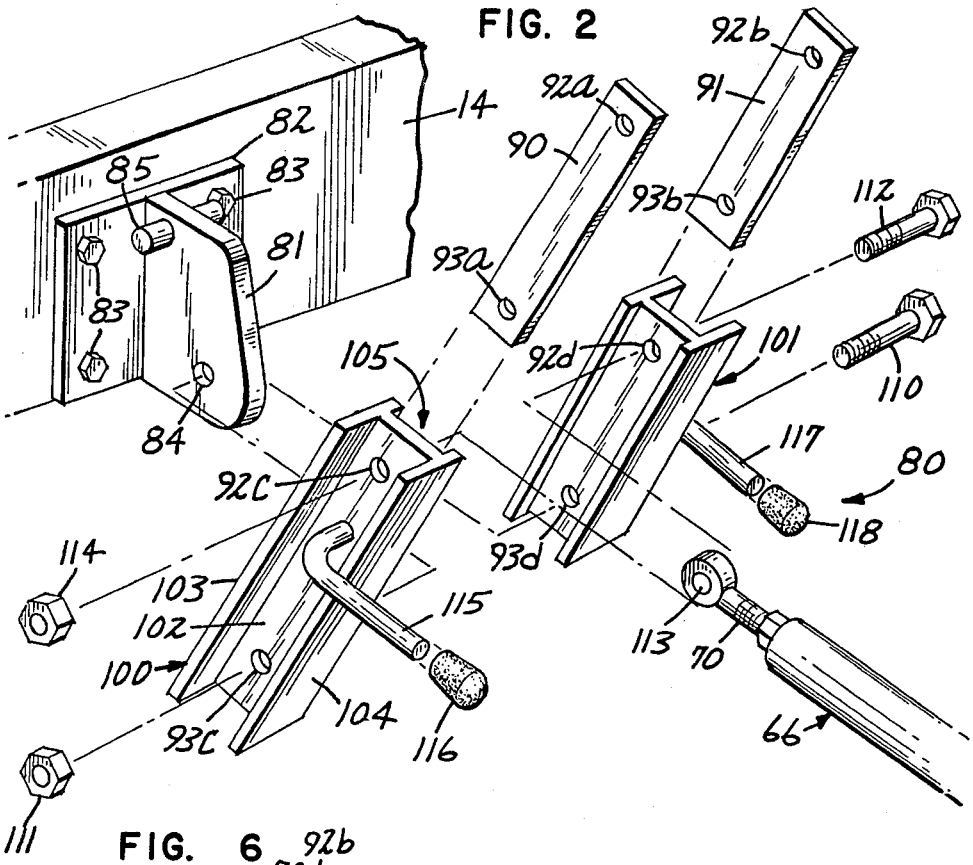
FIG. 2 is an exploded perspective view of the drive coupling of the present invention.
Figure 6:
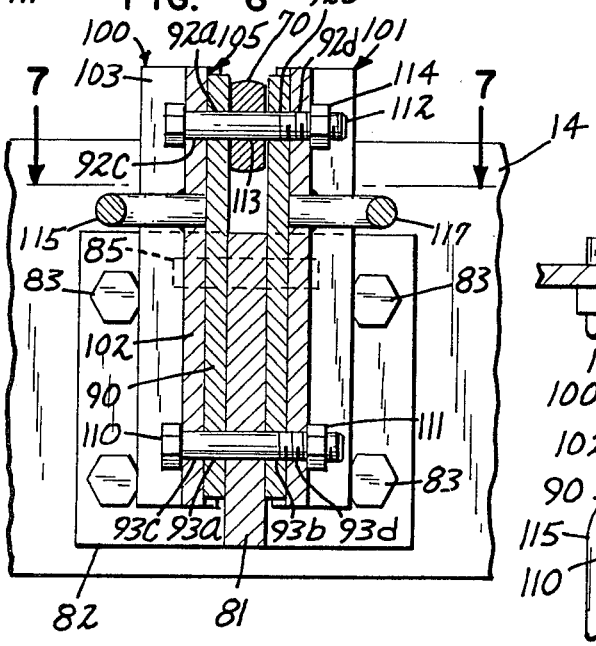
FIG. 6 is an end elevation view of the drive coupling.
Figure 7:
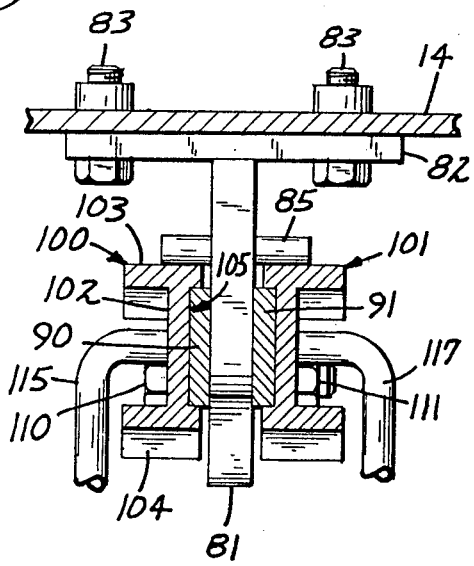
FIG. 7 is a cross-sectional view taken along lines 7—7 of FIG. 6.

A drive coupling, generally designated by reference number 80, operatively couples the arm 70 to the support frame 14. As seen in the figures, and particularly with reference to FIG. 2, drive coupling 80 includes a friction plate 81 which is attached to frame member 14 by means of an attachment plate 82. Attachment plate 82 is attached to the frame by a plurality of bolts 83. Friction plate 81 is a piece of steel welded to attachment plate 82 so as to project perpendicularly from support frame 14. The friction plate is positioned on the support member 14 in alignment with motor means 22.

Friction plate 81 has a hole 84 in its lower edge which is substantially coaxial with pivot pin 26 of the hinge assembly and the corresponding hinge assembly for the other side of the bed, not shown. Although it is not absolutely necessary that hole 84 be coaxial with the pivot points for the bed, it is preferable as this will prevent binding or stress when the drive coupling is called upon to slip in certain circumstances as described further below. A stop member 85 is provided towards the top of the friction plate near the attachment plate. In the embodiment shown, the stop member comprises a short piece of steel rod secured in a hole in friction plate 81 to extend outwards on either side, but of course separate welded stop members could be used on either side.

A pair of friction lining members 90, 91 are provided for frictional engagement with the sides of friction plate 81. Friction lining members 90 and 91 in the preferred embodiment are industrial brake lining material, although it is possible to use other materials including steel. Friction lining members 90 and 91 are in the form of elongate bars having flat sides. Each has a hole **92*a*, 92*b* at one end, and another hole 93*a*, 93*b*** near the other end.

Friction lining members 90 and 91 are sandwiched in contact with the sides of friction plate 81 and are held in place by clamping members 100 and 101 which are identical in configuration except that one is the reversed mirror image of the other. Clamping member 100 consists of a elongate bar portion 102 with a pair of flange portions 103 and 104 welded to its top and bottom, respectively. A recess portion 105 is formed between the side of bar portion 102 and the flange portions so as to receive friction lining member 90, and flange portions 103 and 104 do not extend beyond friction lining member 90. Clamping member 101 is similarly constructed of a elongate portion and flange portions and is configured to receive friction lining member 91. Clamping members 100 and 101 have an I-beam configuration in order to provide sufficient stiffness in the lateral plane to apply an even friction force along the length of friction lining members 90 and 91. The clamping members can be made by welding suitable bar stock pieces together, or alternatively an extrusion of suitable strength and dimension could be used. The clamping members have upper holes **92*c* and 92*d* and lower holes 93*c* and 93*d* which match up with the corresponding holes on friction lining members 90 and 91**.

Clamping members 100, 101 and friction lining members 90, 91 are held together in sandwich fashion on friction plate 81 by bolt 110 and nut 11. Bolt 110 passes through holes **93*b*, 93*d*, hole 84 of the friction plate, and holes 93*a* and 93*c*. Nut 111 is tightened to provide the desired degree of frictional contact between the members 90, 91 and the sides of friction plate 81. Bolt 112 passes through holes 92*a*–92*d* at the upper ends of the clamping members 100, 101 and friction lining members 90, 91, also passing through hole 113 in a boss at the end of arm 70 of the linear actuating motor. The fitting at the end of arm 70 is narrow enough that it is not frictionally clamped between the brake lining members, but is free to pivot on bolt 112. A stop leg 115 is secured to clamping member 102 and extends backwardly and downwardly as shown. A rubber foot 116 caps the stop leg. On the other clamping member, a similar stop leg 117 and rubber foot 118** are provided.

Figure 3:
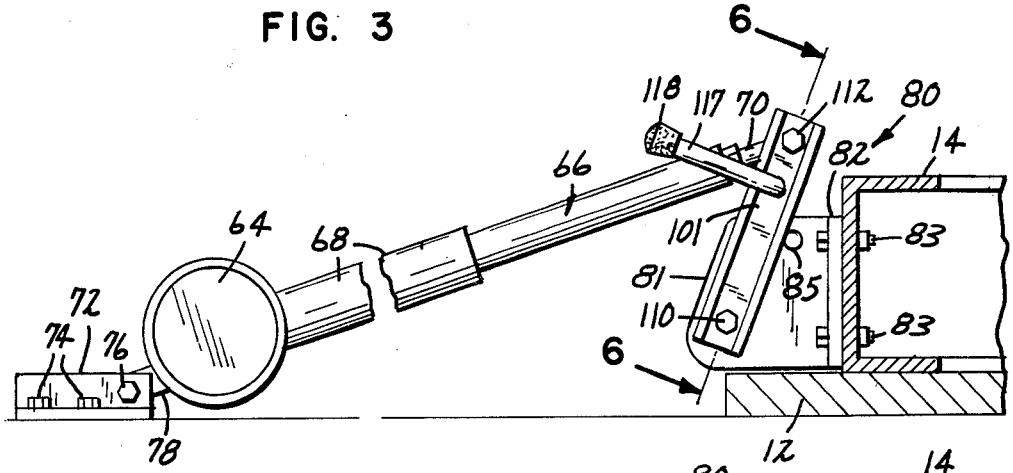
FIG. 3 is a side elevation taken along the lines 3—3 of FIG. 1.
Figure 4:
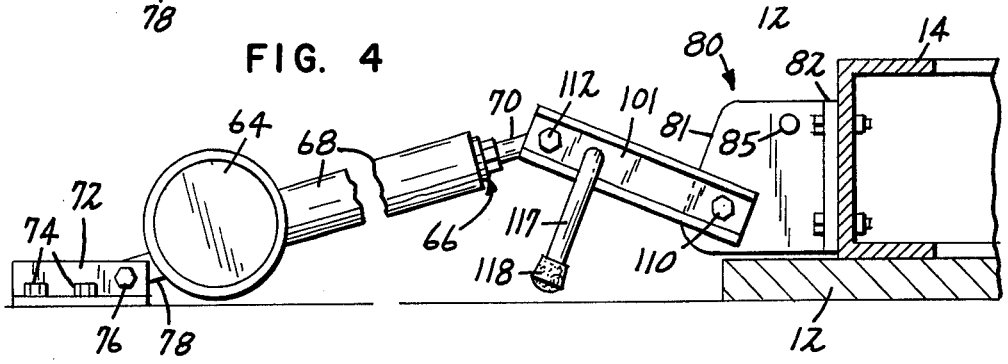
FIG. 4 is a view similar to FIG. 3 showing the drive coupling in a different position.

FIG. 3 shows the drive coupling in normal use position, with the bed in its horizontal position. Nuts and bolts 110, 111 and 112, 114 are tightened to give the required frictional engagement with the friction plate to provide the operation as described below. The lining materials engage the friction plate with sufficient force to permit the motor, in normal operation, to pivot the bed between the horizontal use position, shown in FIG. 3, and the vertical storage position, shown in FIG. 5. However, the friction force is small enough to permit the bed to swing down, or stay down, independently of the motor drive in the event that an obstacle or a large force is applied to the bed while it is being raised. For example, if a person were sitting on the bed and someone actuated the motor to fold the bed up, the added force on the bed would cause the drive coupling to slip and allow the motor to drive to the up position while leaving the bed in the down position. This is illustrated in FIG. 4. In the preferred embodiment, the motor is of sufficiently low power that it would not be capable of lifting the bed with a person on it; instead it would stall, and a thermal cutout switch on the motor would protect it. However, the drive coupling 80 provides a further safety backup by permitting slippage under these circumstances. Also, the drive coupling protects against abuse of the entire system in the event that children were to try to drive the bed part way up by motor and then jump or play on the free end of the bed. In such circumstances the weight of the children, acting through the relatively long moment arm of the bed, would be sufficient force to cause the drive coupling to slip and allow the bed to go to the horizontal position. This would prevent possible damage or bending to parts of the motor drive or drive coupling.

The use of industrial brake lining for lining members 90, 91 provides a number of advantages. The brake lining material will have a longer life than a other materials, it is more forgiving of range of adjustment pressure, and its friction force is more predictable and constant over life than other materials such as steel. Steel linings would work, but initial adjustment is more critical and the friction force is likely to change after a number of cycles. Also, after a number of cycles take place it is possible that filings could present a problem.

Since different beds or other pivoting loads might have different weights, depending upon the type of mattress, decorative panel or the like used, it is not practical to specify a torque for the bolts and nuts to give a predetermined friction force. However, in field installation, a few test cycles will readily lead to the appropriate adjustment force.

Figure 5:
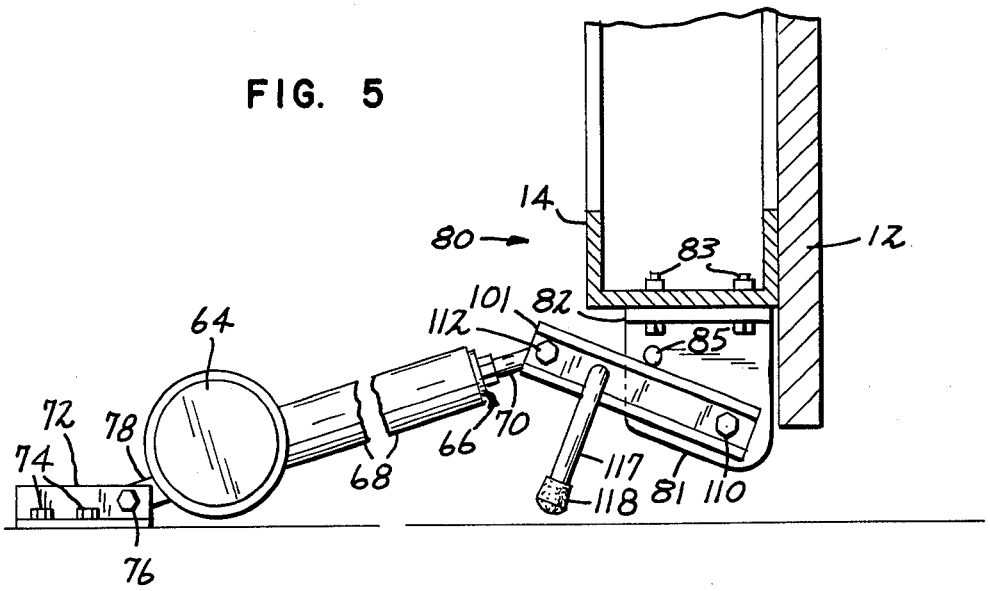
FIG. 5 is a view similar to FIG. 3 showing the drive coupling in another position.

Referring again to FIG. 4, in the event that the drive coupling has been caused to slip to the position shown in FIG. 4, normal operation can be restored either by driving the motor to the down position which will return the apparatus to the position indicated in FIG. 3, or by manually lifting the bed to the up position which will restore the apparatus to the normal up position as indicated in FIG. 5. In the case of power failure or other failure of the motor while the bed is in its storage position, it can be manually pulled to the horizontal position by pulling on the outward end of the bed to overcome the friction force of the drive coupling and lower the bed.

Stop legs 115 and 117 are provided to limit the downward motion of the clamping members 100, 101, to prevent them from going past center or "over center" with respect to the drive motor and drive arm. In ideal circumstances, with all parts positioned and adjusted properly, these stop legs would be unnecessary. However, in normal use, slight errors and tolerance buildup in the positioning of various components can lead to a possibility of driving the stop members past center.

This could occur from the position of the apparatus in FIG. 4, following either a manual pulling of the bed to the horizontal position, or the motor having driven to the up position while the bed is held down. Starting from the position in FIG. 4, if a person were to manually lift the bed to the up position, the friction force applied to the friction lining members and clamping members 100, 101 would tend to rotate them further in a downward direction. If the motor were inadvertently placed a slight distance too far away from the bed frame, i.e., to the left in FIG. 4, the geometry might be such that that lifting of the bed could drive pivot bolt 112 over center with respect to the drive motor, which of course would render the power drive ineffective for further movement of the bed. However, stop legs 115 and 117 would engage the floor or other mounting surface prior to the occurrence of the above condition, so that the drive could not be moved past center.

Thus it will be seen that the invention provides an improved drive coupling for a power operated pivoting support member, such as a folding wall bed, that normally couples the drive motor of the power means to the pivoting surface, and that permits slippage in the event of the application of unusual and excessive force so that the support member can move independently of the power drive means.

What is claimed:

1. A drive coupling for a power operated folding support structure comprising:

a first force transmitting member comprising a friction plate, and means attaching said friction plate to the folding structure and projecting outwardly therefrom; and second force transmitting members comprising a pair of friction members, and means including a pair of clamping members, one positioned alongside each of the friction members, and including bolts for urging the clamping members together to apply friction force to the friction plate, to provide a normally operative drive coupling between the folding support structure and the power operating apparatus, and to permit slippage between the force transmitting members in the event of the application of excessive force to the folding support structure.

2. Apparatus according to claim 1 wherein one of said bolts attaches through the clamping means and a hole in the friction plate and wherein another of said bolts connects to the power operating device, whereby a pivoting motion of the friction members with respect to the friction plate takes place in the event of the excessive force.

3. A power operated folding support structure comprising:

a support member;

means for pivotally mounting said support member for pivotal motion thereof about an axis between a generally vertical position and a generally horizontal position;

counterbalance means operatively connected to said support member for reducing the amount of force needed to move said support member between its horizontal and vertical positions;

motor means for providing the force required to move said support member between its horizontal and vertical positions, said motor means including a drive arm reciprocally movable in a generally linear direction; and a drive coupling connecting said drive arm to said support member, said drive coupling including a friction plate attached to and projecting perpendicularly from the support member, a pair of friction members positioned one on either side of the friction plate and pivotally connected at first ends of the friction members to the friction plate, means pivotally connecting said drive arm to the friction members near their other ends, and clamping members positioned alongside the friction member and a plurality of bolts connecting between them for urging said friction members in frictional engagement with the friction plate to provide a normally operative drive coupling between the support member and the drive arm, and to permit slippage between the friction members and the friction plate in the event of the application of excessive force to the support member.

4. Apparatus according to claim 3 further including a stop leg attached to said clamping member and projecting downwardly therefrom for engaging the floor or other bottom support for preventing movement thereof beyond an overcenter relationship with the linear drive arm.

* * * * *